United States Patent [19]

Skolnick

[11] Patent Number: 4,608,024

[45] Date of Patent: Aug. 26, 1986

[54] BOOK WITH PUPPET

[76] Inventor: Joel B. Skolnick, 600 5th St., Brooklyn, N.Y. 11215

[21] Appl. No.: 688,869

[22] Filed: Feb. 11, 1985

Related U.S. Application Data

[62] Division of Ser. No. 310,983, Oct. 13, 1981, Pat. No. 4,508,515.

[51] Int. Cl.[4] ..... A63H 33/38

[52] U.S. Cl. ..... 446/148

[58] Field of Search ..... 446/147, 148, 327; 434/178; 281/1, 15 R; 283/63 R

[56] References Cited

U.S. PATENT DOCUMENTS

| | | | |
|---|---|---|---|
| 1,405,134 | 1/1922 | Hoyme | 446/73 X |
| 1,490,295 | 4/1924 | Stephens | 446/147 X |
| 2,756,448 | 7/1956 | Werbe | 446/327 X |
| 3,789,546 | 2/1974 | Morrison | 446/327 |
| 3,918,180 | 11/1975 | Chamberlin | 446/327 X |
| 4,233,772 | 11/1980 | Hamar | 446/329 X |

*Primary Examiner*—Mickey Yu

*Attorney, Agent, or Firm*—Darby & Darby

[57] ABSTRACT

A hollow puppet is secured to a book and is sufficiently large that a user can introduce a hand to manipulate the puppet within its interior. The puppet may be detachably secured to the book.

8 Claims, 5 Drawing Figures

FIG. 1
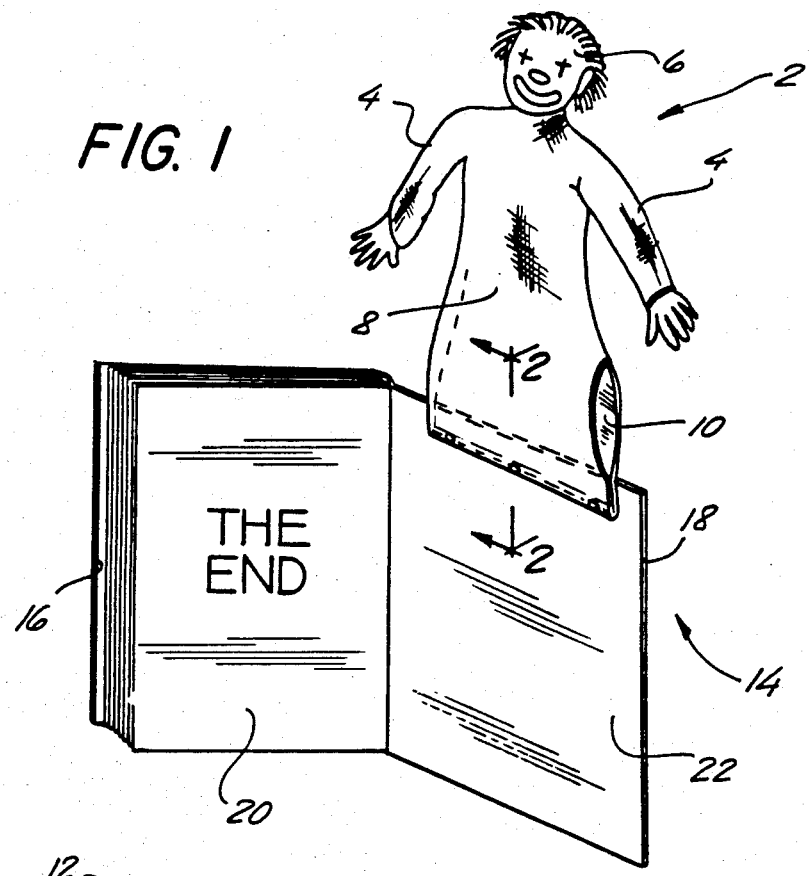
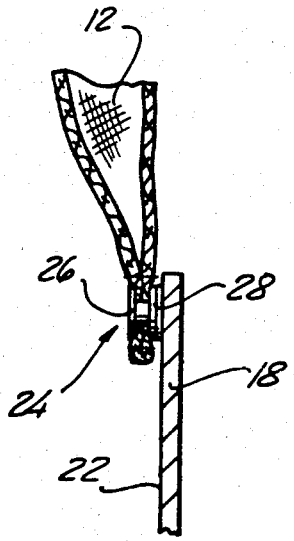
FIG. 2
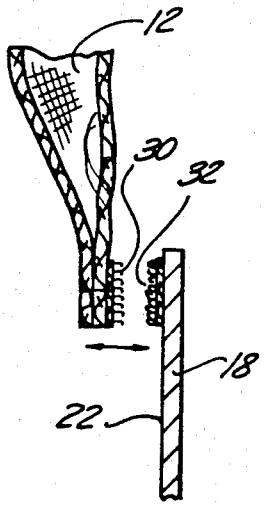
FIG. 3

BOOK WITH PUPPET

This application is a division of application Ser. No. 310,983 filed Oct. 13, 1981, now U.S. Pat. No. 4,508,515.

The invention pertains to books which are suitable for use by children, and particularly pertains to books in which a child may, while reading, manipulate an attached puppet.

U.S. Pat. No. 3,918,180 discloses a book in which a puppet is movably secured to or otherwise introducible in a book. The puppet is disposed in aligned slots which are located in the pages of the book, and can be moved within a groove formed by the slots while the book is being read. Since the slots extend through the pages of the book, the amount of surface area on the pages available for words or illustrations is reduced. Furthermore, the puppet must be relatively small if a substantial amount of printing or illustration is to be placed on the pages of the book without inconveniently increasing its size. Therefore, the puppet is not large enough for a child to manipulate by using an entire hand to, e.g., wave the arms or nod the head.

It is an object of the invention to provide a book with a puppet which permits a child to manipulate the puppet using an entire hand.

It is another object to provide a book with a puppet which permits a larger amount of visual or illustrative material to be presented on the pages of the book without interruption by slots.

It is a further object to provide a book with a puppet which is easy for a child to use while being relatively inexpensive to manufacture.

These objects, among others which will appear hereinafter, are achieved in the invention by securing a hollow puppet made of a foldable material to the book. The puppet has an opening through which a child can introduce a hand to manipulate the puppet within its interior. Preferably, the puppet is secured to one or both covers of the book and may, if desired, be detachably secured thereto. The latter permits the puppet to be detached by the child for use independently of the book.

BRIEF DESCRIPTION OF THE DRAWINGS

The drawings show presently preferred but nonetheless illustrative embodiments of the invention, in which:

FIG. 1 shows a first embodiment of the invention;

FIG. 2 is a view partly in cross section, along line 2—2 of FIG. 1, illustrating one means by which the puppet may be detachably secured to the book;

FIG. 3 is a view similar to FIG. 2 which illustrates another means by which the puppet may be detachably secured to the book.

DETAILED DESCRIPTION OF PREFERRED EMBODIMENTS

Figure 4:
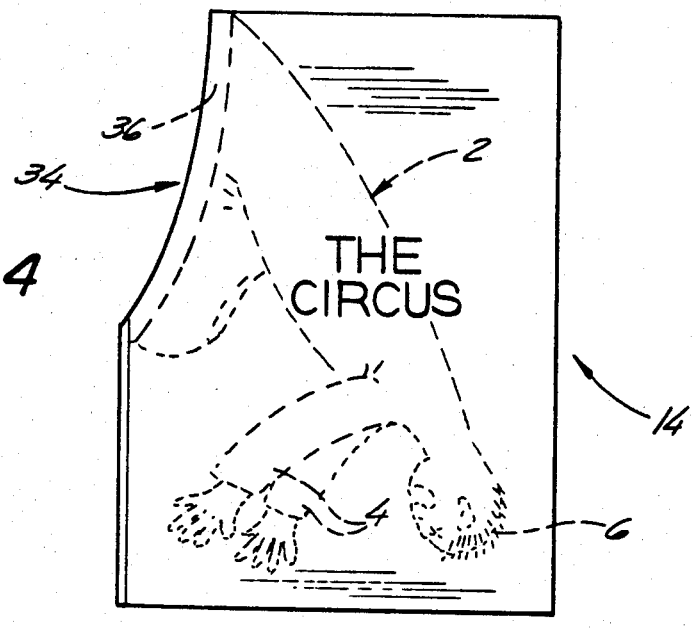
FIGS. 4 and 5 show a second embodiment of the invention with the book closed and opened, respectively.

FIG. 1 shows a puppet generally indicated by reference numeral 2. Here, puppet 2 is in the shape of a clown, although other shapes may be used. Puppet 2 has two arms 4, a head 6, and a torso 8.

Puppet 2 is hollow and is preferably made of a thin flexible and foldable material such as a plastic film or a textile product. For example, the puppet can be formed of two sheets of material cut to the desired shape and attached near the edges thereof, such as by sewing, an adhesive, heat sealing, etc. If desired, the film or textile may be printed with features for puppet 2 or may alternatively bear cloth or plastic strips which i.e. indicate a nose with a circular dot of a furry substance or the like. The particular theme of clown 2 and the decorative material printed or otherwise installed on it form no part of the invention.

Figure 5:
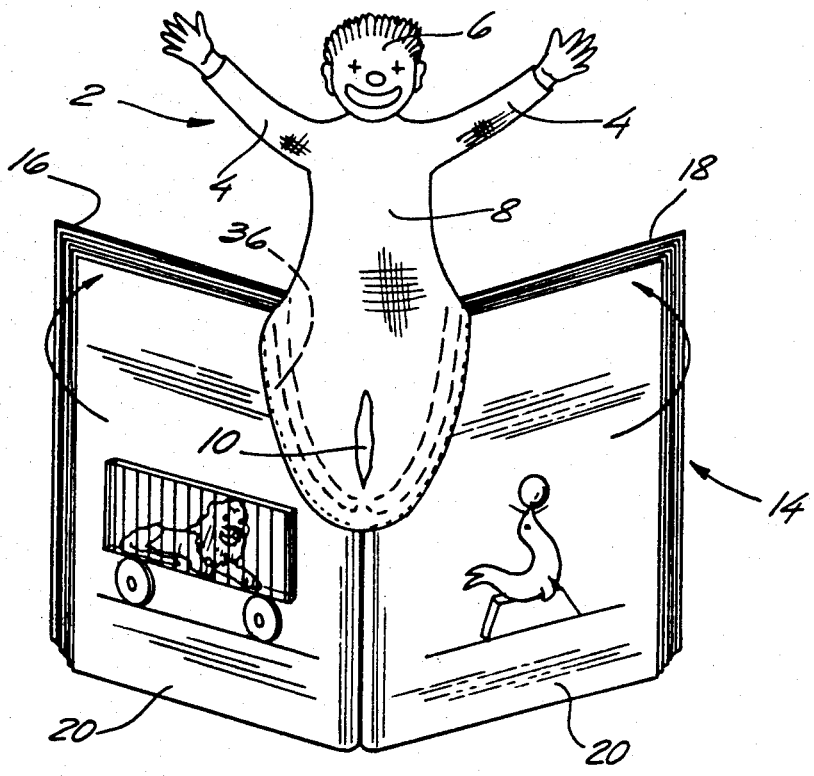

To permit a user, such as a child, to introduce a right hand into puppet 2 and manipulate its arms 4, head 6, or torso 8 either individually or together, puppet 2 has an opening 10 which permits access to its interior 12 (see FIGS. 2 and 3). Opening 10 is here shown to be a slot in the side of puppet 2 at the bottom of its torso 8, but the shape and location of opening 10 may be varied. Opening 10 may be located either on the front or the back of puppet 2, and one alternative location for opening 10 is illustrated in FIG. 5, discussed below.

A book generally indicated by reference numeral 14 has a front cover 16, a rear cover 18, and a plurality of individual pages 20. Pages 20 may be printed or otherwise marked with words, numbers, or pictures, and can also support other materials with different textures. The content of pages 20 and the manner of its presentation form no part of this invention.

In the embodiments of FIGS. 1–3, puppet 2 is detachably secured to rear cover 18 on its inner surface 22. However, the puppet may be secured to the outer surface of rear cover 18 or may alternatively be located on either surface of front cover 16. Puppet 2 may alternatively be permanently fixed to book 14 as by sewing, gluing, or other suitable technique. Because puppet 2 is of a thin, flexible, and foldable material, it can be folded into the book and the book can be closed.

Two alternative ways in which puppet 2 can be secured to book 14 are illustrated in FIGS. 2 and 3. In FIG. 2, a snap generally indicated by reference numeral 24 is shown. Snap 24 is located at the bottom left corner of puppet 2 as viewed in FIG. 1. Snap 24 has a female component 26 which is secured to puppet 2 and also has a male component 28 which is secured to inner surface 22 of rear cover 18. In this example, only one snap 24 is shown but any suitable number of snaps 24 may be positioned as desired and needed anywhere on rear cover 18 and puppet 2. Puppet 2 is preferably secured near the top of inner surface 22 so that puppet 2 is not obscured by any of the pages 20 while book 14 is being read. However, puppet 2 may be secured below the top edge of inner surface 22 in any suitable manner. When snaps 24 are closed, puppet 2 is fixably secured to book 14 and can be manipulated by a child without becoming detached. Alternatively, snaps 24 may be opened to permit puppet 2 to be detached from book 14.

In the alternative structure shown in FIG. 3, the means for detachably securing the puppet 2 to book 14 is a statistical fastener such as VELCRO. Other suitable statistical fasteners may be used. In this example, a strip 30 of the hook component of a VELCRO fastener is secured to puppet 2 either entirely along its bottom or at various locations on its bottom edge. A corresponding strip 32 of a VELCRO loop component is secured to inner surface 22 of rear cover 18 so that strips 30 and 32 mate together when puppet 2 is secured to book 14. Strips 30 and 32 can be continuous or divided.

The structures shown in FIGS. 2 and 3 are not to be considered as limiting. Any other suitable means for detachably securing puppet 2 to book 14 may be used instead. Such alternatives may include, e.g., zippers, buttons, or hooks.

Turning now to FIGS. 4 and 5, there is shown an embodiment in which puppet 2 is placed at a different location on book 14. In this embodiment, front cover 16, rear cover 18, and pages 20 are notched to form a central gap generally indicated by reference numeral 34. Gap 34 in this example is smooth and generally U-shaped, but may, for example, be rectangular or semicircular. While gap 34 may be shaped as desired, all the notches and gaps on pages 20 and front and rear covers 16 and 18 respectively should conform with each other for the sake of appearance.

Gap 34 is bounded by a curved peripheral region 36 in the top center of book 14. In this example, puppet 2 is permanently secured to book 14 at peripheral region 36, as by gluing, sewing, heat sealing, or other means. The region of attachment of puppet 2 may be concealed by a sheet secured to the inner surfaces of covers 16 and 18. However, puppet 2 may alternatively be detachably secured to book 14, as by one of the structures described above or by other suitable technique.

In this example, opening 10 is located in the center of puppet 2 at its front. However, as mentioned above, the location of opening 10 may be different.

In this example, puppet 2 is made of a material which is sufficiently thin that puppet 2 may be folded into book 14 prior to closure of book 14, as is shown in FIG. 4. Because puppet 2 is secured to front and rear cover 16 and 18 at peripheral region 36, puppet 2 may be between any two of pages 20 or between one page 20 and front or rear cover 16 or 18. Thus, when puppet 2 is folded into book 14 as is illustrated in FIG. 4, book 14 may be opened to any page without raising puppet 2. This is different from the embodiment of FIG. 1, in which folding puppet 2 into book 14 will prevent any pages 20 located between puppet 2 and rear cover 18 from being turnable unless puppet 2 is folded up out of book 14.

What is claimed is:

1. A book comprising:

first and second covers, each having at least an upper edge and inside surface;

at least one page disposed between said inside surfaces of said first and second covers, said at least one page having a continuous surface without any breaks therein;

a flexible, hollow puppet having a hollow interior; and means for securing said puppet to one of said inside surfaces near said upper edge;

wherein said puppet includes an opening through which a user can introduce their entire hand while said puppet is secured to near said upper edge, said puppet being extendable above said one of said inside surfaces upper edge, and foldable onto said inside surface of one of said covers so that it is concealable when said book is closed.

2. The book according to claim 1 where said means for securing comprises means for detachably securing said puppet to said book.

3. The book according to claim 2 wherein said flexible material is plastic film.

4. The book according to claim 2 wherein said means for detachably securing comprises a statistical fastener having one component which is secured to said book and another component secured to said puppet.

5. The book according to claim 4 wherein said statistical fastener is VELCRO.

6. The book according to claim 2 wherein said detachable securing means comprises a snap fastener having one component which is secured to said book and another component which is secured to said puppet.

7. The book according to claim 1 wherein said puppet is comprised of two sheets of material of a desired shape and attached at the edges thereof, said puppet being collapsible to a flat state.

8. The book according to claim 7 wherein said opening is adjacent to said means for securing and through which said hand can be inserted.

* * * * *